US006682470B2

(12) United States Patent
Lin et al.

(10) Patent No.: US 6,682,470 B2
(45) Date of Patent: Jan. 27, 2004

(54) CUTTING APPARATUS WITH FOLD-MARK FUNCTION

(76) Inventors: Chuan Sheng Lin, P.O. Box 26-757, Taipei (TW); Ing-Kai Huang, P.O. Box 26-757, Taipei (TW)

( * ) Notice: Subject to any disclaimer, the term of this patent is extended or adjusted under 35 U.S.C. 154(b) by 28 days.

(21) Appl. No.: 09/785,987

(22) Filed: Feb. 16, 2001

(65) Prior Publication Data

US 2002/0115548 A1 Aug. 22, 2002

(51) Int. Cl.[7] ..... B31B 1/14

(52) U.S. Cl. ..... 493/373; 493/353; 493/359; 493/364; 83/345; 83/425.3; 83/425.4

(58) Field of Search ..... 493/353, 356, 493/357, 359, 361, 363, 364, 365, 366, 367, 368, 373; 83/863, 864, 865, 885, 345, 425.3, 425.4, 500

(56) References Cited

U.S. PATENT DOCUMENTS 3,741,534 A * 6/1973 Stumpf ..... 270/30.13
3,831,502 A * 8/1974 Tokuno ..... 493/353
3,882,765 A * 5/1975 Tokuno ..... 493/352
4,328,727 A * 5/1982 Tokuno ..... 83/106
4,559,855 A * 12/1985 Schieck ..... 83/425.3
4,567,653 A * 2/1986 Heller et al. ..... 140/105
4,781,668 A * 11/1988 Mowry ..... 493/365
5,024,644 A * 6/1991 Bunch, III ..... 493/357
5,275,075 A * 1/1994 Keech et al. ..... 83/499
5,797,830 A * 8/1998 Flores et al. ..... 271/127
6,008,599 A * 12/1999 Beck ..... 180/446
6,286,404 B1 * 9/2001 Miglietta ..... 83/498

* cited by examiner

*Primary Examiner*—Rinaldi I. Rada
*Assistant Examiner*—Gloria R Weeks

(57) ABSTRACT

A cutting apparatus comprises a casing, a driving mechanism and an upper roller set. The roller set comprises a first roller, a second roller, a third roller and a fourth roller parallel to each other and rollers have a plurality of cutting blades and fold-mark forming blades. The driving mechanism has a motor to rotate the rollers and has a controller to control the rotation direction of the motor. The cutting apparatus provides two inlets for articles to be cut and has fold-mark function, whereby the paper or cardboard can be cut to desired size and folded.

10 Claims, 6 Drawing Sheets

CUTTING APPARATUS WITH FOLD-MARK FUNCTION

FIELD OF THE INVENTION

The present invention relates to a cutting apparatus, especially to a cutting apparatus with two paper inlets and fold-mark function, whereby the paper or cardboard can be cut to desired size and folded.

BACKGROUND OF THE INVENTION

As computers become more and more popular, people like to print their own name card or greeting by computer and printer or even digital still camera. However, the printer generally prints paper with specific sizes such as A4 and B5, the paper printed from the printer requires a paper cutter or a blade to cut to a desired size for name card or greeting card. The cutting process is not precise and dangerous to hurt user's hand.

Alternatively, the paper printed from the printer can also be cut by industrial cutting apparatus. However, the industrial cutting apparatus are expensive and huge to hinder the household usage.

Moreover, the printed paper or cardboard is generally folded to form folded name card or greeting card. The folding operation is generally executed manually. Therefore, the fold mark formed manually is unbeautiful and the folding process is cumbersome.

SUMMARY OF THE INVENTION

It is the object of the present invention to provide a cutting apparatus performing cutting in dual direction, i.e., longitudinal and transverse directions and having compact feature. Moreover, the cutting apparatus can form fold-mark on the article to be cut and folded such that the article can be easily cut and folded.

To achieve above object, the cutting apparatus of the present invention comprises a casing, a driving mechanism and an upper roller set. The roller set comprises a first roller, a second roller, a third roller and a fourth roller parallel to each other and rollers have a plurality of cutting blades and fold-mark forming blades. The driving mechanism has a motor to rotate the rollers and has a controller to control the rotation direction of the motor. The cutting apparatus provides two inlets for articles to be cut and has fold-mark function, whereby the paper or cardboard can be cut to desired size and folded.

The various objects and advantages of the present invention will be more readily understood from the following detailed description when read in conjunction with the appended drawing, in which:

DESCRIPTION OF THE INVENTION

Figure 1:
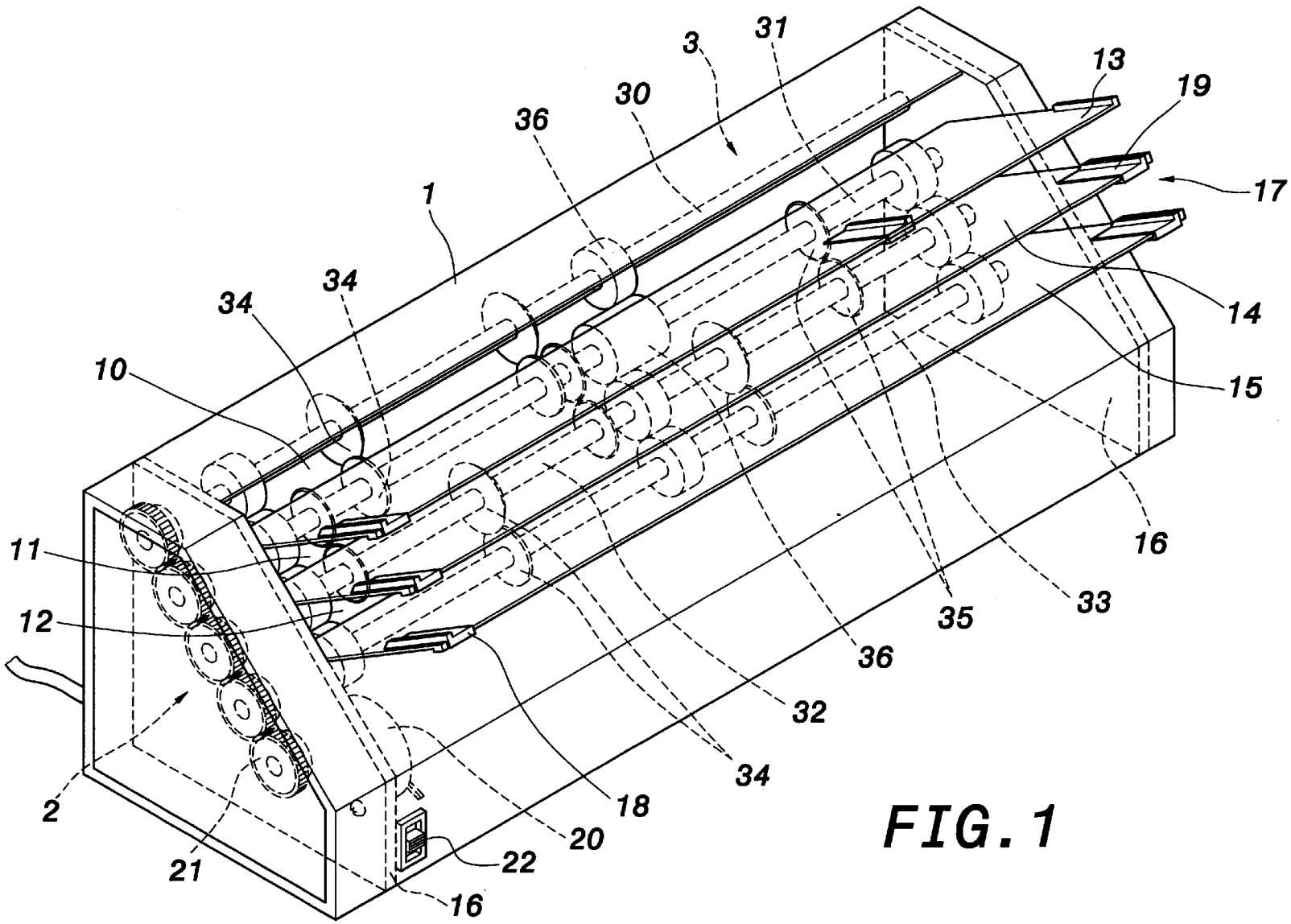
FIG. 1 shows the perspective view of the present invention.
Figure 2:
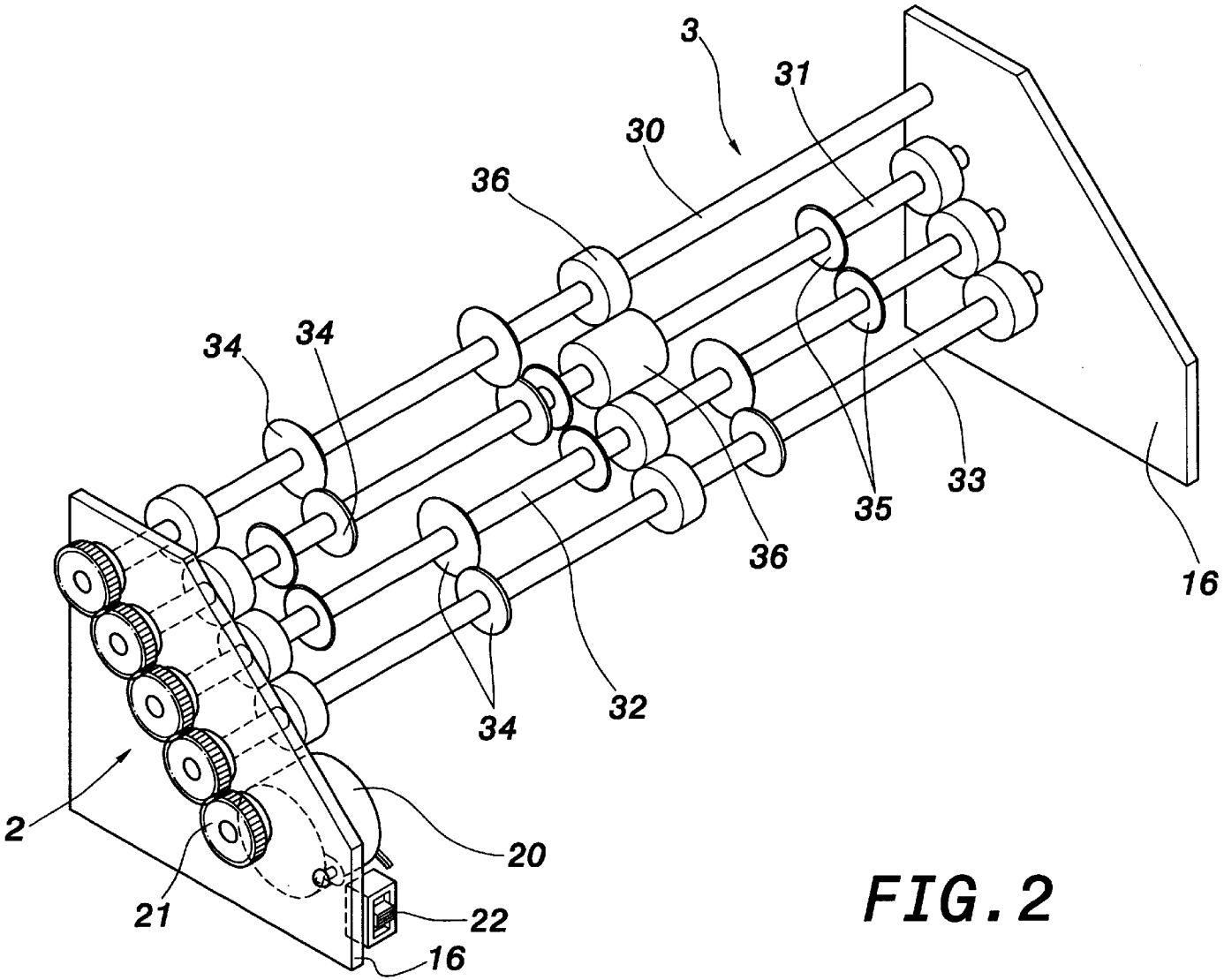
FIG. 2 shows the internal view of the present invention.

FIGS. 1 and 2 show the perspective and internal views of the present invention, respectively. The cutting apparatus provided by the present invention comprises a casing 1, a driving mechanism 2 and an upper roller set 3. The casing 1 comprises a first feeding gutter 10, a folding-function feeding gutter 11 and a second feeding gutter 12. The casing 1 further comprises a first feeding plate 13 pivotally arranged outside the first feeding gutter 10; a folding-function feeding plate 14 pivotally arranged outside the folding-function feeding gutter 11; and a second feeding plate 15 pivotally arranged outside the second feeding gutter 12. Each of the first feeding plate 13, the folding-function feeding plate 14 and the second feeding plate 15 has a clamping means 17. The clamping means 17 is composed of a fixed edge 18 and a movable edge 19. The fixed edge 18 is arranged on one side of the first feeding plate 13, the folding-function feeding plate 14 or the second feeding plate 15; and the movable edge 19 is slidable along the first feeding plate 13, the folding-function feeding plate 14 or the second feeding plate 15.

The upper roller set 3 is arranged within the casing and comprises a first roller 30, a second roller 31, a third roller 32 and a fourth roller 33. The first roller 30, the second roller 31, the third roller 32 and the fourth roller 33 are parallel to each other and pivotally mounted between two sidewalls 16 of the casing 1. The first roller 30, the second roller 31, the third roller 32 and the fourth roller 33 each has a wheel 36 arranged thereon. Moreover, the first roller 30, the second roller 31, the third roller 32 and the fourth roller 33 each has a plurality of cutting blades 34 arranged thereon. The cutting blade 34 of the first roller 30 is aligned with the cutting blade 34 of the second roller 31; the cutting blade 34 of the third roller 32 is aligned with the cutting blade 34 of the fourth roller 33. The cutting blades 34 aligned to each other are also intersected with each other. Therefore, the cutting apparatus can perform cutting operation in longitudinal direction (or transverse direction) between the first roller 30 and the second roller 31; and cutting operation in transverse direction (or longitudinal direction) between the third roller 32 and the fourth roller 33.

The rollers 30, 31, 32 and 33 are rotated by the motor 20 through a plurality of gears 21.

Figure 3:
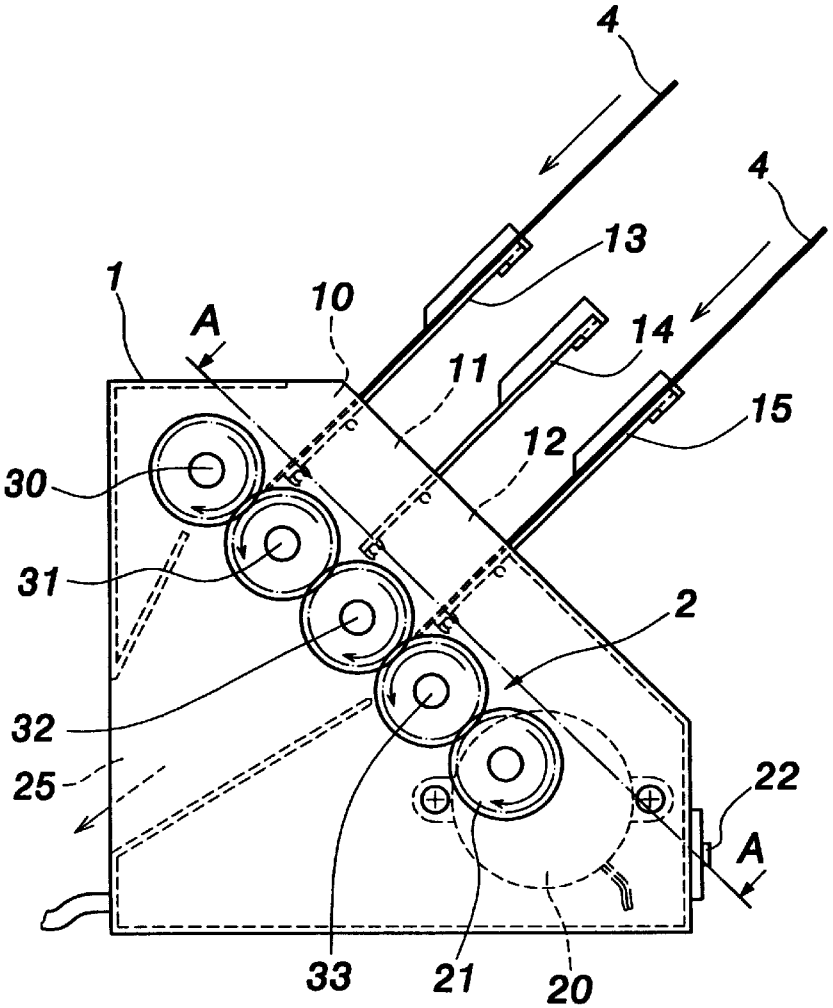
FIG. 3 is a view showing the operation of the present invention.
Figure 5:
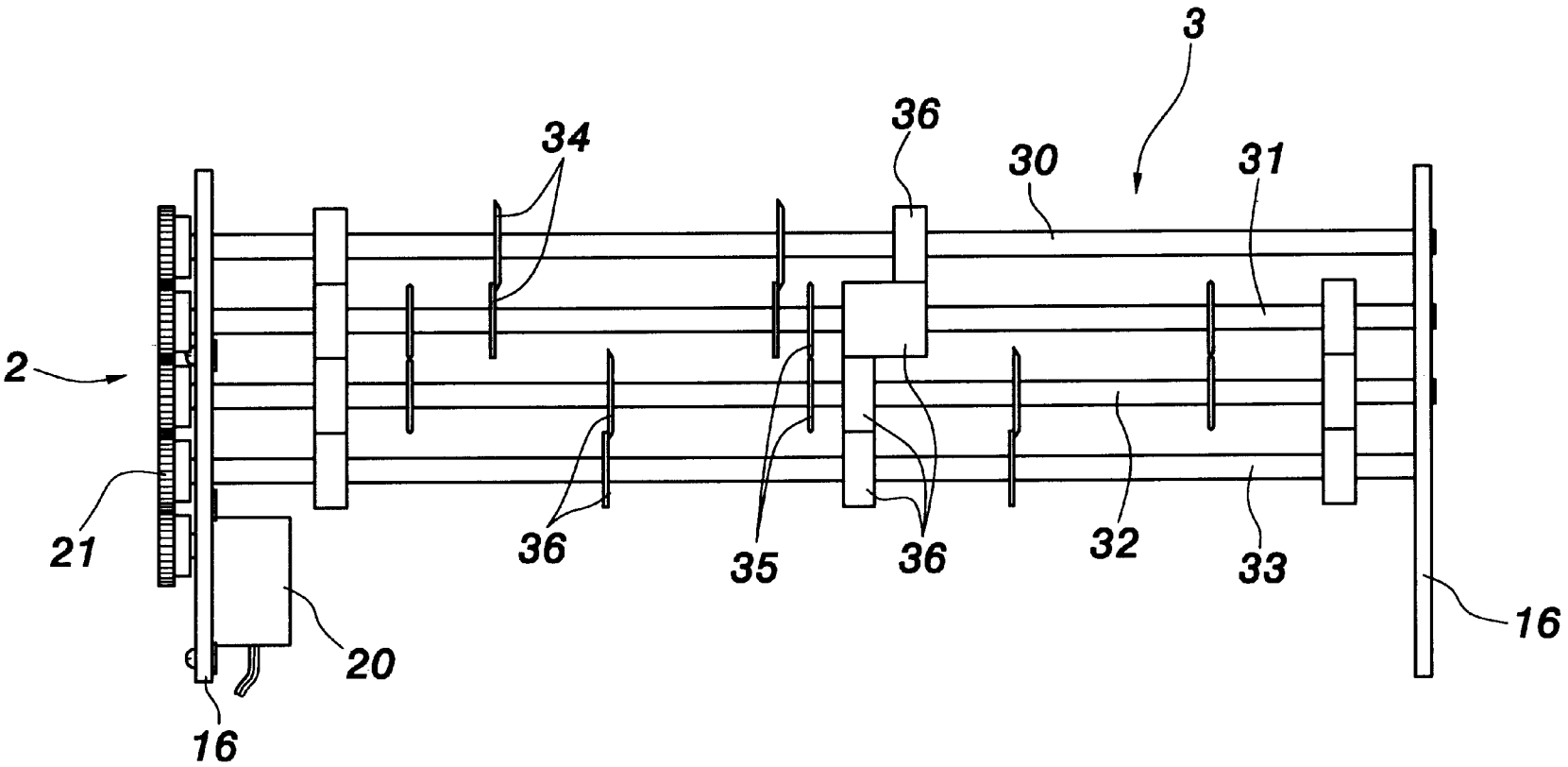
FIG. 5 shows a sectional view along line A—A in FIG. 3.

With reference now to FIGS. 3 and 5, to use the cutting apparatus of the present invention, the cutting apparatus is powered on and then the article 4 to be cut is guided by the wheels 36 of the first roller 30, the second roller 31, the third roller 32 and the fourth roller 33. The article 4 to be cut can be paper or cardboard and firstly placed on the first feeding plate 13 and the second feeding plate 15. Afterward, the article 4 to be cut is guided into the casing 1 through the first feeding gutter 10 and the second feeding gutter 12. The cut article 4 leaves the cutting apparatus of the present invention from a paper outlet 25. The cutting apparatus of the present invention can simultaneously perform cutting operation through the first feeding gutter 10 and the second feeding gutter 12. Therefore, the articles 4 to be cut can be simultaneously fed into the first feeding gutter 10 and the second feeding gutter 12. The cutting apparatus can perform cutting operation in longitudinal direction (or transverse direction) along the first feeding gutter 10 and cutting operation in transverse direction (or longitudinal direction) along the second feeding gutter 12, thus speeding the cutting process.

With reference now to FIGS. 1 and 2, the second roller 31 and the third roller 32 are provided with a plurality of fold-mark forming blades 35. The fold-mark forming blades 35 on the second roller 31 are aligned with the fold-mark forming blades 35 on the third roller 32. Moreover, the fold-mark forming blades 35 on the second roller 31 has slight contact with the fold-mark forming blades 35 on the third roller 32. The driving mechanism 2 has a controller 22 to control the rotation direction of the motor 20. Therefore, the rotation of the motor 20 can be in forward or backward or stopped by the controller 22.

Figure 4:
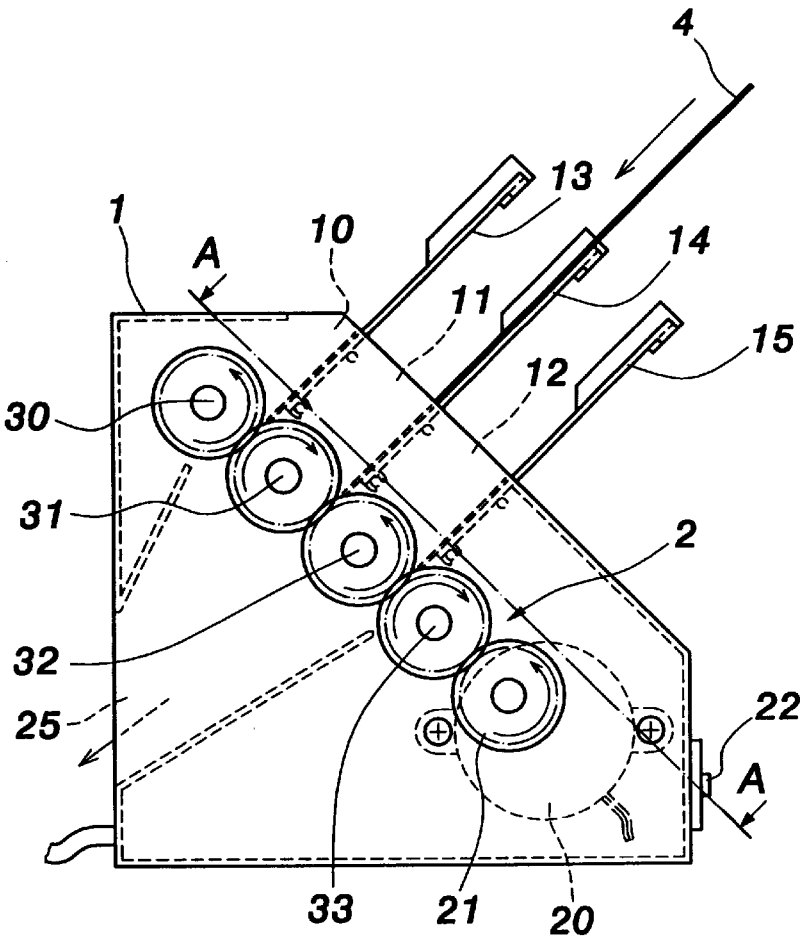
FIG. 4 is another view showing the operation of the present invention.

With reference now to FIGS. 4 and 5, if the motor 20 is in forward (backward) rotation when performing the cutting task, the controller 22 is operated to change the motor 20 to backward (forward) rotation. At this time, the cut article 4 can be put on the folding-function feeding gutter 11 and enters the casing 1 through the folding-function feeding plate 14. The cut article 4 is guided by the wheel 36 to form a fold mark. Afterward, the cut article 4 with fold mark leaves the casing 1 through the paper outlet 25.

Moreover, to facilitate the clamping of the cut article 4 when the cutting apparatus of the present invention forms the fold-mark for the cut article 4, the clamping means 17 is composed of two opposite movable edges 19. Moreover, the casing 1 has a mark corresponding to the fold-mark forming blades 35. The cut article 4 can be aligned with the fold-mark forming blades 35 by the mark on the casing 1 and clamped by the two movable edges 19. Therefore, the fold-mark can be easily formed on the article 4.

By the above-mentioned cutting apparatus, the article 4 can be cut to desired size and then easily folded to desired shape. The cut and folded article can be used for name card or greeting card.

Figure 6:
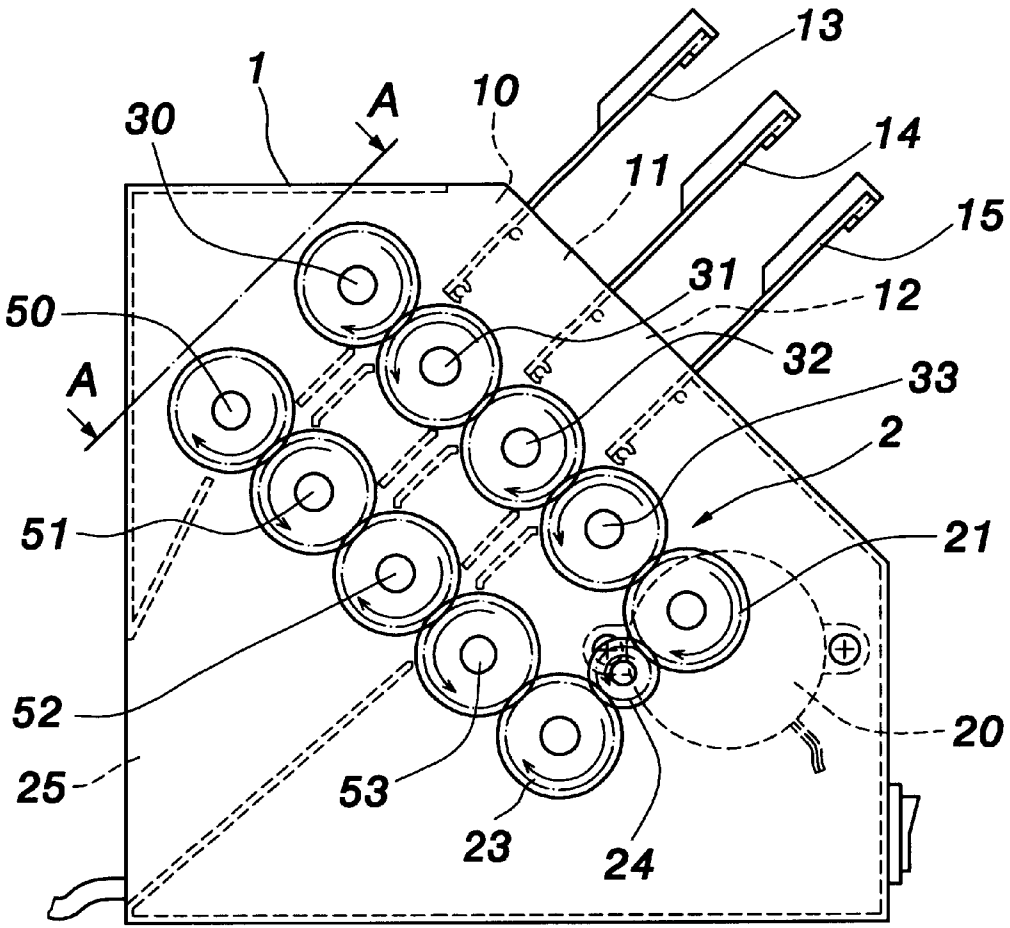
FIG. 6 shows another preferred embodiment of the present invention.
Figure 7:
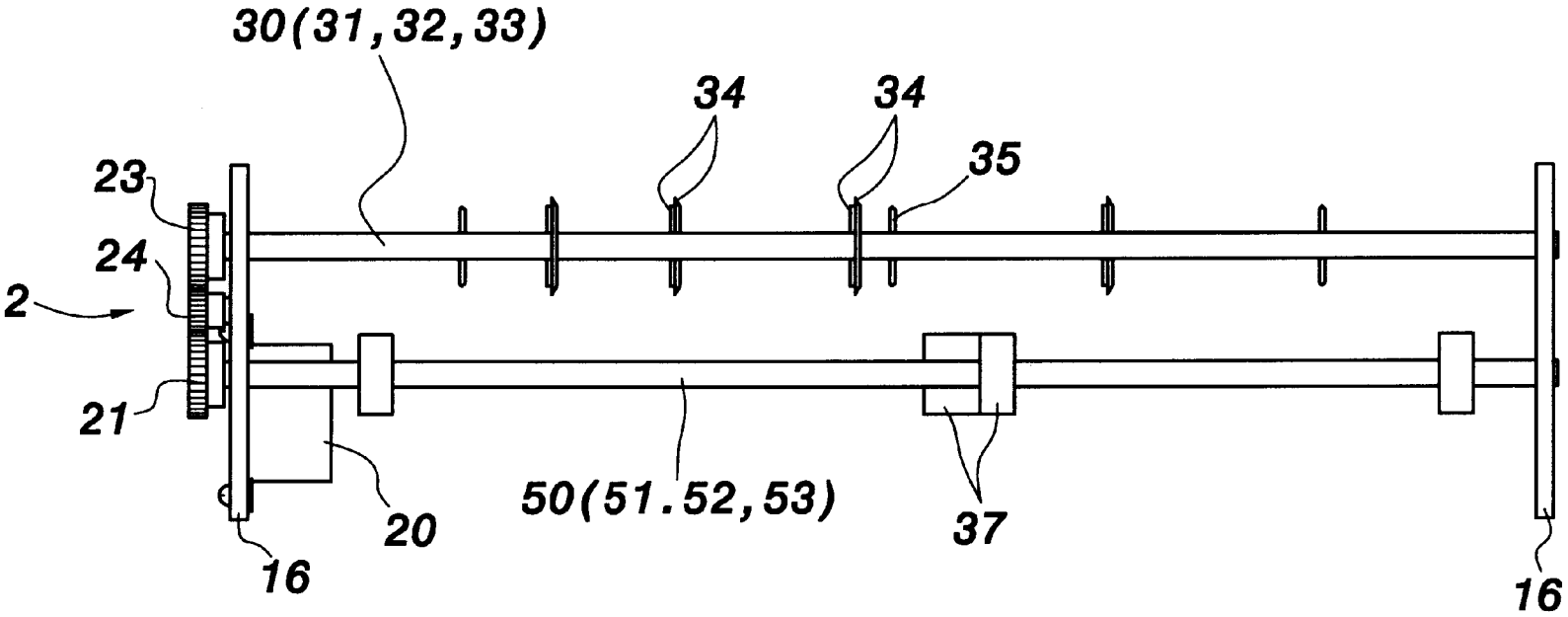
FIG. 7 shows a sectional view along line A—A in FIG. 6.

FIGS. 6 and 7 show another preferred embodiment of the present invention, the cutting apparatus according to the second preferred embodiment of the present invention further comprises a lower roller set 5 composed of a first roller 50, a second roller 51, a third roller 52 and a fourth roller 53. The original cutting blade 34 and fold-mark forming blades 35 are arranged on the rollers 50, 51, 52 and 53. The upper roller set 3 has only wheels 36. The driving mechanism 2 further comprises an idler wheel 24 and a plurality of gears 23 to drive the lower roller set 5.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A paper cutting apparatus performing a cut function and a fold-mark function comprising:

a casing comprising a first feeding gutter, a second feeding gutter, and a folding-function feeding gutter;

a first feeding plate being pivotally arranged outside the first feeding gutter;

a second feeding plate being pivotally arranged outside the second feeding gutter;

a folding-function feeding plate being pivotally arranged outside the folding-function feeding gutter;

an upper roller set arranged within the casing and comprising a first roller, a second roller, a third, and a fourth roller; a plurality of wheels being mounted on the rollers, the rollers being provided with a plurality of cutting blades, that performs the cut function on a first article inputted from said first or said second feeding gutter, the second roller and the third roller perform said fold-mark function by having a plurality of fold-mark forming blades mounted thereon, said fold-mark forming blades being aligned each to the other and used to form fold-mark score lines on a second article inputted from the folding-function feeding gutter; and a driving mechanism having a motor to rotate the upper roller set and a controller can switch between the cut function and the folding function through controlling the rotation directions of the motor, wherein a first rotation direction of said motor only permits the intake of said first article from said first or said second feeding gutter, and a second rotation direction of said motor only permits the intake of said second article from the folding-function feeding gutter.

2. The cutting apparatus with fold-mark function as in claim 1, wherein each of the first feeding plate, the second feeding plate and the folding-function feeding plate has a clamping means; the clamping means is composed of a fixed edge and a movable edge.

3. The cutting apparatus with fold-mark function as in claim 2, wherein the clamping means of the folding-function feeding plate has two movable edges.

4. The cutting apparatus with fold-mark function as in claim 1, wherein the article is cut in the longitudinal direction or the transverse direction through the first feeding gutter between the first roller and the second roller, the article being cut in the opposed direction through the second feeding gutter between the third roller and the fourth roller.

5. The cutting apparatus with fold-mark function as in claim 1, wherein the cutting blades of the first roller and the second roller are aligned and intersected to each other; the cutting blades of the third roller and the fourth roller are aligned to each other.

6. The cutting apparatus with fold-mark function as in claim 1, wherein the article is name card or greeting card made by paper.

7. The cutting apparatus with fold-mark function as in claim 1, wherein the motor drives the upper roller set through a plurality of gears.

8. The cutting apparatus with fold-mark function as in claim 1, wherein the controller controls the motor to rotate forward, backward or stop the rotation.

9. The cutting apparatus with fold-mark function as in claim 1, wherein the casing further houses a lower roller set having the cutting blade; the upper roller set having only a plurality of wheels.

10. The cutting apparatus with fold-mark function as in claim 1, wherein the lower roller set is driven by the motor through an idler wheel and a plurality of gears.

* * * * *